US009950844B2

(12) United States Patent
Barber et al.

(10) Patent No.: US 9,950,844 B2
(45) Date of Patent: Apr. 24, 2018

(54) CHILD-RESISTANT CLOSURE SYSTEMS FOR CONTAINERS

(71) Applicant: TapTango, LLC.

(72) Inventors: Launce R. Barber, Bradenton, FL (US); Corey R. Vaughan, Seattle, WA (US); Thomas J. A. Zuber, Fort Lee, NJ (US)

(73) Assignee: TAPTANGO, LLC, Richmond, VA (US)

( * ) Notice: Subject to any disclaimer, the term of this patent is extended or adjusted under 35 U.S.C. 154(b) by 61 days.

(21) Appl. No.: 14/216,668

(22) Filed: Mar. 17, 2014

(65) Prior Publication Data

US 2014/0284299 A1 Sep. 25, 2014

Related U.S. Application Data

(60) Provisional application No. 61/801,895, filed on Mar. 15, 2013.

(51) Int. Cl.
*B65D 50/04* (2006.01)
*B05B 11/00* (2006.01)

(52) U.S. Cl.
CPC ..... *B65D 50/045* (2013.01); *B05B 11/0032* (2013.01); *B65D 50/046* (2013.01); *B65D 2215/02* (2013.01)

(58) Field of Classification Search
CPC ..... B65D 50/045; B65D 50/046; B65D 2215/02; B65D 50/04; B65D 50/048; B05B 11/0032

(Continued)

(56) References Cited

U.S. PATENT DOCUMENTS 3,435,975 A * 4/1969 Weigand ..... B65D 41/065 215/214
3,514,003 A * 5/1970 Fitzgerald ..... B65D 50/06 215/221

(Continued)

OTHER PUBLICATIONS

USPTO Office Action for U.S. Appl. No. 14/216,639, dated Mar. 10, 2015, 9 pages.

(Continued)

*Primary Examiner* — Andrew T Kirsch
*Assistant Examiner* — Don M Anderson
(74) *Attorney, Agent, or Firm* — Patent Law of Virginia, PLLC; Brian J. Teague

(57) ABSTRACT

A child-resistant closure system for a container includes an overcap having a pair of levers, each opposite the other and formed into a side facing of the overcap, each lever including a lower vertical member on a rear side thereof, the overcap including a pair of partial threads extending horizontally along an inner surface at the bottom of the overcap, each partial thread 180 degrees from the other, and a cylindrical collar configured to receive the overcap thereon, the collar having an opening configured to receive a dispenser tip and bottleneck of the container therethrough, the collar forming a mechanical bond with the bottleneck, the collar including a neck having a pair of neck threads formed around an external surface thereof, each neck thread 180 degrees apart from the other on the neck, each neck thread terminating at a truncated vertical wall formed on the neck external surface.

6 Claims, 16 Drawing Sheets

(58) Field of Classification Search
USPC ..... 215/213, 214, 221, 330
See application file for complete search history.

(56) References Cited

U.S. PATENT DOCUMENTS

| | | | | | |
|---|---|---|---|---|---|
| 3,690,519 | A * | 9/1972 | Wassilieff | B65D 41/0492 | 220/915 |
| 3,797,705 | A | 3/1974 | Cooprider | | |
| 3,827,606 | A | 8/1974 | Knickerbocker | | |
| 4,065,036 | A | 12/1977 | Kirk, Jr. | | |
| 4,162,746 | A | 7/1979 | Anderson et al. | | |
| 4,244,495 | A | 1/1981 | Lorscheid et al. | | |
| 4,368,830 | A | 1/1983 | Soughers | | |
| 4,480,762 | A * | 11/1984 | Thomas | B65D 50/045 | 215/216 |
| 4,801,093 | A | 1/1989 | Brunet et al. | | |
| 4,830,224 | A | 5/1989 | Brison | | |
| 4,944,429 | A | 7/1990 | Bishop et al. | | |
| 5,492,251 | A | 2/1996 | Albini et al. | | |
| 5,725,128 | A | 3/1998 | Foster | | |
| 5,826,756 | A | 10/1998 | Foster | | |
| 5,908,125 | A * | 6/1999 | Opresco | B65D 50/046 | 215/216 |
| 6,164,498 | A | 12/2000 | Faughey et al. | | |
| 6,612,450 | B1 * | 9/2003 | Buono | B65D 41/0414 | 215/225 |
| 6,926,174 | B1 | 8/2005 | Heldt | | |
| 7,168,594 | B2 | 1/2007 | Law et al. | | |
| 8,104,643 | B2 | 1/2012 | Pruvot | | |
| 9,352,348 | B2 | 5/2016 | Greiner-Perth | | |
| 2005/0098172 | A1 | 5/2005 | Anderson | | |
| 2007/0080174 | A1 | 4/2007 | Coe et al. | | |
| 2007/0137649 | A1 | 6/2007 | Matsumoto et al. | | |
| 2008/0142468 | A1 * | 6/2008 | Delagrange | B65D 47/0804 | 215/209 |
| 2008/0210229 | A1 | 9/2008 | Corbacho | | |
| 2008/0245896 | A1 | 10/2008 | Welp | | |
| 2011/0240679 | A1 | 10/2011 | Langlos | | |
| 2013/0175303 | A1 | 7/2013 | Donnette et al. | | |
| 2013/0270298 | A1 | 10/2013 | Dejonge | | |
| 2014/0263455 | A1 | 9/2014 | Keenan | | |
| 2015/0088069 | A1 | 3/2015 | Kim | | |
| 2015/0284177 | A1 | 10/2015 | Patil et al. | | |
| 2016/0243319 | A1 | 8/2016 | Szymiczek et al. | | |

OTHER PUBLICATIONS

USPTO Office Action for U.S. Appl. No. 14/216,595, dated Mar. 11, 2015, 9 pages.

* cited by examiner

SECTION 11-11

SECTION 13-13

CHILD-RESISTANT CLOSURE SYSTEMS FOR CONTAINERS

CROSS-REFERENCE TO RELATED APPLICATION

The present application claims the benefit under 35 U.S.C. § 119(e) of U.S. Provisional Patent Application No. 61/801,895 to the inventors, filed Mar. 15, 2013, the entire contents of which is hereby incorporated by reference herein.

BACKGROUND

1. Field

Example embodiments in general relate to child-resistant closure systems for containers.

2. Related Art

The Consumer Product Safety Commission ("CPSC") proposed a rule in early 2012 to require child-resistant ("CR") packaging for any over-the-counter or prescription product containing the equivalent of 0.08 milligrams or more of an imidazoline, a class of drugs that includes tetrahydrozoline, naphazoline, oxymetazoline, and xylometazoline, in a single package. Imidazolines are a family of drugs that are vasoconstrictors indicated for nasal congestion and/or ophthalmic irritation. Products containing imidazolines can cause serious adverse reactions, such as central nervous system ("CNS") depression, decreased heart rate, and depressed ventilation in children treated with these drugs or who accidentally ingest them. Based on the scientific data, the CPSC has preliminarily found that availability of 0.08 milligrams or more of an imidazoline in a single package, by reason of its packaging, is such that special packaging is required to protect children under 5 years old from serious personal injury or illness due to handling, using, or ingesting such a substance. The CPSC has taken this action under the Poison Prevention Packaging Act of 1970.

Accordingly, as it is expected that this rule will become law, manufacturers will be required to develop child-resistant closure (CRC) systems for their nasal pump sprayers and squeeze bottle dispenser products (such as Visine®), as each of these products contain the equivalent of 0.08 milligrams or more of an imidazoline. In doing so, one goal is to ensure that the newly developed dispensers are robust enough to prevent children five years old and under from being able to inadvertently open the container to use or ingest its contents, while still being "senior friendly" to mature adults.

SUMMARY

An example embodiment is directed to a child-resistant closure system for a container. The system includes an overcap, the overcap including a pair of levers, each lever 180 degrees apart from the other and formed into a side facing of the overcap, each lever including a lower vertical member provided on a rear side thereof which protrudes into the interior space of the overcap, the overcap including a pair of partial threads extending horizontally along an inner surface at the bottom of the overcap, each partial thread 180 degrees apart from the other, and a cylindrical collar configured to receive the overcap thereon, the collar having an opening configured to receive a dispenser tip and bottleneck of the container therethrough, the collar forming a mechanical bond with the bottleneck, the collar including a neck having a smaller diameter than that of the collar, the neck having a pair of neck threads formed around an external surface thereof, each neck thread 180 degrees apart from the other on the neck, each neck thread terminating at a truncated vertical wall formed on the neck external surface. The overcap is locked to the collar to prevent actuation of the dispenser tip of the container by rotating the overcap onto the neck in a clockwise direction, so that the lower vertical members of the levers deflect outward over the neck and ride along the neck threads during rotation, until they come into engagement with the vertical walls on the neck, to snap over the vertical walls and lock the overcap in place on the collar, along with each partial thread on the inner surface of the overcap engaging the underside of a corresponding neck thread. The overcap is unlocked by simultaneously pressing both levers inward, which causes the lower vertical members of the levers to deflect outward and away from the vertical walls of the neck, and then rotating the overcap in a counter-clockwise direction to remove it from the collar and expose the dispenser tip of the container.

BRIEF DESCRIPTION OF THE DRAWINGS

Example embodiments will become more fully understood from the detailed description given herein below and the accompanying drawing, wherein like elements are represented by like reference numerals, which are given by way of illustration only and thus are not limitative of the example embodiments herein.

DETAILED DESCRIPTION

Figure 1:
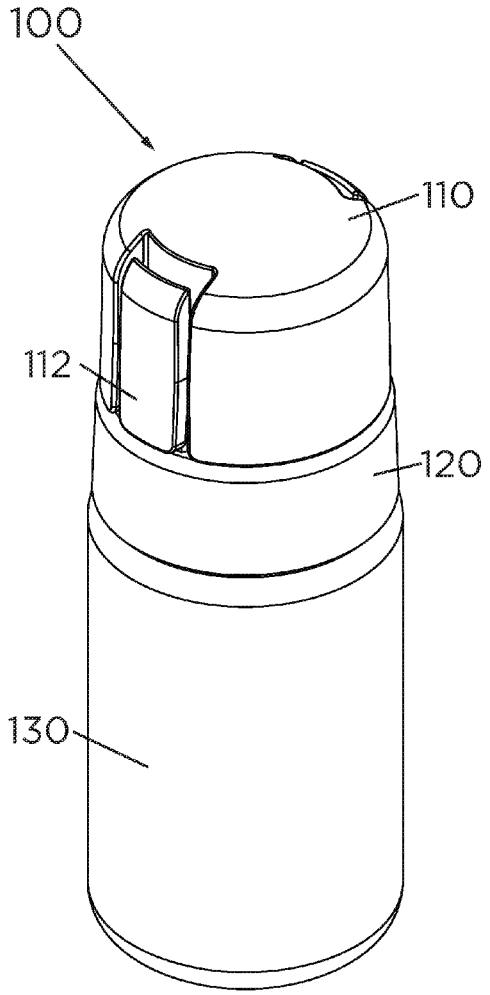
FIG. 1 is a perspective view of a child-resistant closure system for a container according to an example embodiment.

FIG. 1 is a perspective view of a child-resistant closure system for a container according to an example embodiment. The child-resistant closure (CRC) system 100 includes an overcap 110, a collar 120 and a container 130. Each of the overcap 110, collar 120 and container 130 may be injection molded or extruded or otherwise formed of a suitable plastic material, as is known. The overcap 110 includes a pair of levers 112, each 180 degrees from one another on the overcap 110. The levers 112 interface in the locking and unlocking of the overcap 110 to/from the collar 120.

In an example, the CRC system 100 described here and child-resistant based embodiments to be described hereafter may be applicable, but not limited to: single or multi-dose dispensers such as nasal sprayers, ocular sprayers, dermal sprayers, misters, aerators, airless dispensers, air-use dispensers, spouted and non-spouted pump assemblies, and the like. The containers or dispensers foreseeable have applications in the healthcare, home and garden, beauty and food and beverage industries, thus the embodiments described herein are applicable to dispensers or containers configured for, but not limited to dispensing nasal medicine, sunscreens, food products, paints and protectants, deodorants, insect repellants, sealed breath fresheners, ear medicine, dermal medicine, lotions, fragrances, air fresheners, spray starches, oxygen, insecticides, fungicides, herbicides, rodenticides, spray oils, talcs, and spray food stuffs. Further, the CRC systems can be varied in size and applied as a platform to handle any desired viscosity of fluid.

Figure 2:
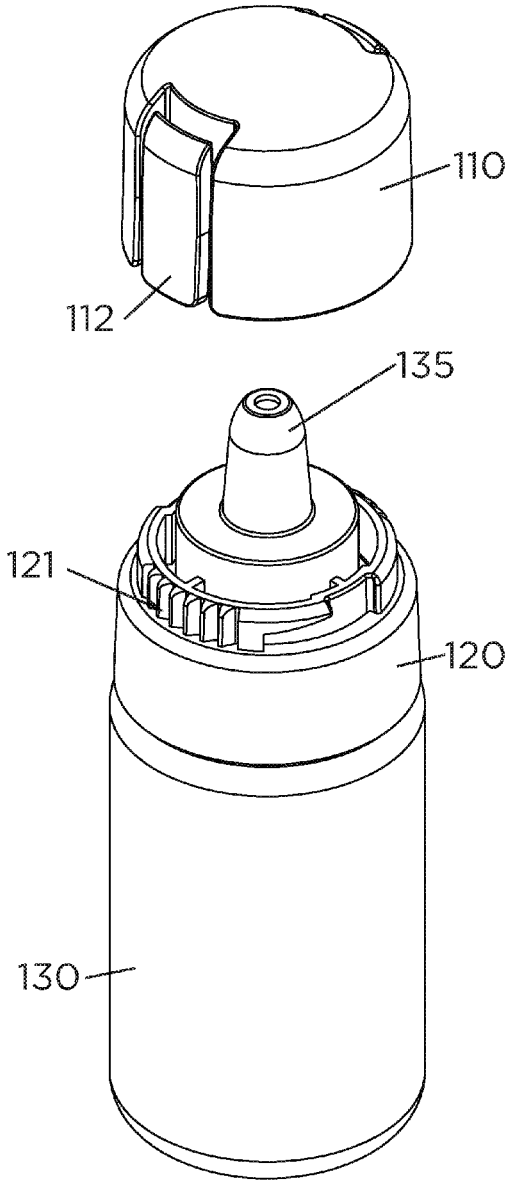
FIG. 2 is a partial exploded view of the system of FIG. 1.
Figure 3:
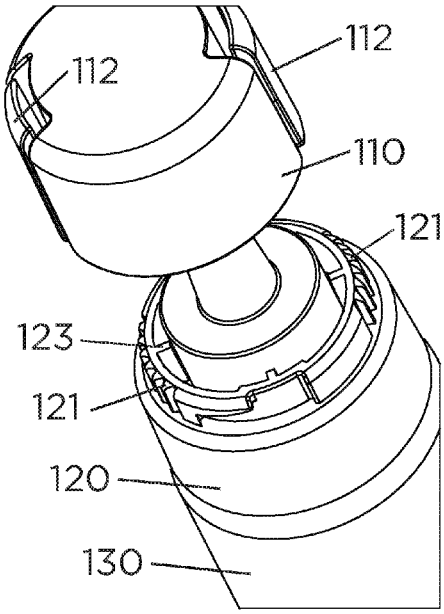
FIG. 3 is an enlarged partial top perspective view showing the overcap separated from the collar.
Figure 5:
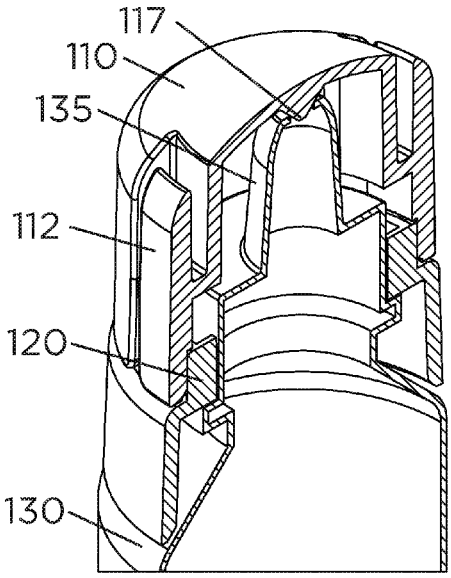
FIG. 5 is a portion of a sectional view of the system taken in the xz-plane.
Figure 4:
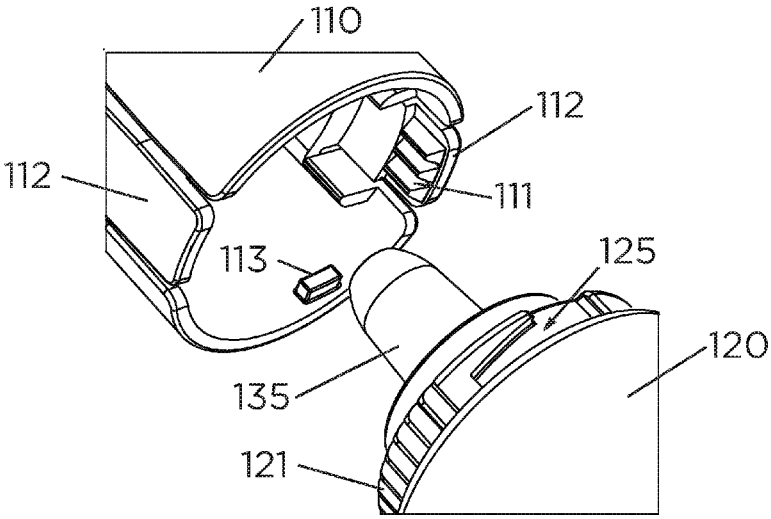
FIG. 4 is an enlarged partial side perspective view showing the overcap separated from the collar, rotated from FIG. 3.

FIG. 2 is a partial exploded view of the system of FIG. 1, FIG. 3 is an enlarged partial top perspective view showing the overcap separated from the collar, FIG. 4 is an enlarged partial side perspective view showing the overcap separated from the collar, rotated from FIG. 3, and FIG. 5 is a portion of a sectional view of the system taken in the xz-plane.

Referring to FIGS. 2-5, the collar includes a set of ribs 123 that locks the collar 120 in place to the container 130, just below the dispenser tip 135 of the container 130. The collar 120 includes a set of serrations 121 on either side thereof in facing relation. These are to engage with serrations 111 formed on the inside of each lever 112 of the overcap 110, as will be explained hereafter. In order for this to be accomplished, a partial or truncated thread 113 on facing sides of the interior of overcap 110 is to be aligned with a pair of oppositely situated mating threads 125 which are formed on the collar 120.

Operation is now described. With overcap 110 in place on the collar 120, actuation of the dispenser tip 135 is locked out. Specifically, the overcap 110 is retained by the two vertical levers 112 with serrations 111 at the base thereof, which mate with the serrations 121 on the collar 120. The closure is engaged by aligning the partial truncated threads 113 on the interior surface of the overcap 110 with the mating threads 125 on the collar 120, then twisting the overcap 110 in a clockwise manner until the levers 112 are forced outward by the positive engagement with the serrations 111/121, but will become vertical once again when fully engaged. Full engagement is felt when the closure comes to a positive stop. The container 130 is sealed by way of a pintle 117 on the overcap 110, which is positively engaged with the dropper tip seated on the container 130.

To release the overcap 110, the levers 112 must be pressed simultaneously in an inward motion, causing the levers 112 at their base to once again deflect outwards and the overcap 110 can be unscrewed, drawn up and off of the dispenser tip 135. With the overcap removed, container 130 is now free to dispense.

Figure 6:
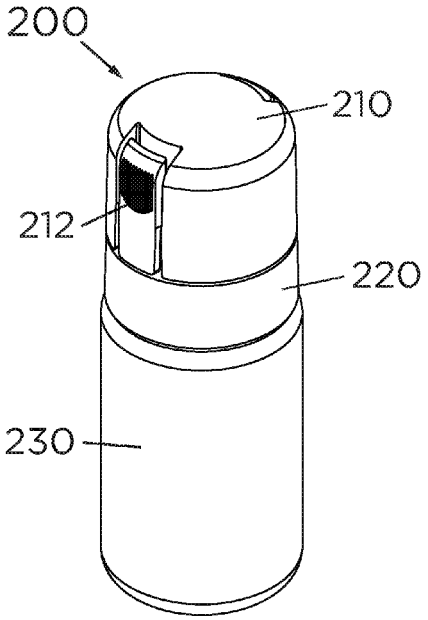
FIG. 6 is a perspective view of a child-resistant closure system for a container according to another example embodiment.
Figure 7:
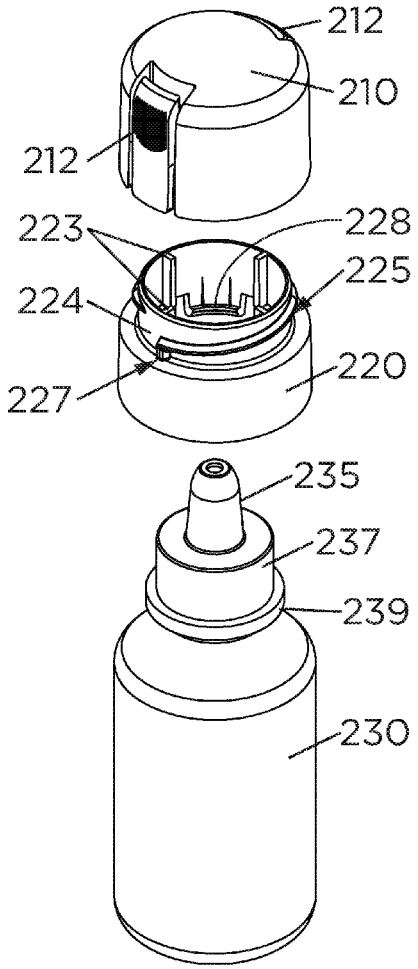
FIG. 7 is an exploded view of the system of FIG. 6.
Figure 9:
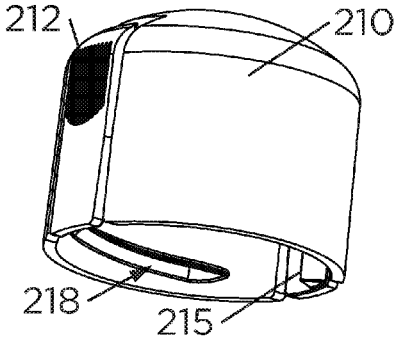
FIG. 9 is a rotated perspective view of the overcap in FIG. 8.
Figure 8:
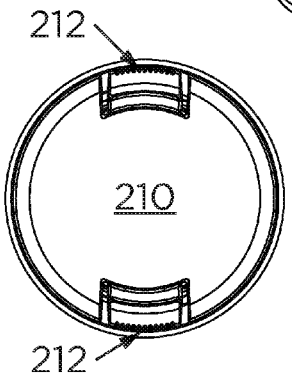
FIG. 8 is a top view of the overcap of the system.

FIG. 6 is a perspective view of a child-resistant closure system for a container according to another example embodiment, FIG. 7 is an exploded view of the system of FIG. 6, FIG. 8 is a top view of the overcap of the system, and FIG. 9 is a rotated perspective view of the overcap in FIG. 8. Referring to FIGS. 6-9, the child-resistant closure (CRC) system 200 includes an overcap 210, a cylindrical collar 220 and a container 230. Each of the overcap 210, collar 220 and container 230 may be injection molded or extruded or otherwise formed of a suitable plastic material, as is known. The overcap 210 includes a pair of levers 212, each 180 degrees from one another on the overcap 210. The levers 212 interface in the locking and unlocking of the overcap 210 to/from the collar 220.

The collar 220 includes a set of ribs 223 that locks the collar 220 in place to the bottleneck 237 of the container 230, just below the dispenser tip 235 of the container 230. The container 230 also includes a rim 239 that is engaged by a pair of interior ribs 228 formed 180 degrees apart on the interior wall of collar 220 to form a mechanical bond. The collar 220 has a neck 224 with a reduced diameter as compared to the collar 220, on which is provided a pair of spaced circular threads 225 on the external surface of neck 224, one thread 225 on either side of neck 224, 180 degrees apart. Each thread 225 terminates at a vertical wall 227.

Referring to FIGS. 8 and 9, each lever 212 has a lower vertical member 215 on a back or rear face thereof, protruding into the interior space of overcap 210. The lower vertical members 215 engage with corresponding threads 225 on the collar neck 224 during rotational engagement of the overcap 210 to seat and lock the overcap 210 on the collar 220, as will be described in more detail hereafter. Additionally, the inner surface of the overcap 210 is provided with a pair of partial threads 218 (which extend horizontally along only part of the inner surface of overcap 210) that are 180 degrees apart. Partial threads 218 also engage with corresponding threads 225 on the neck 224 of collar 220.

Figure 10:
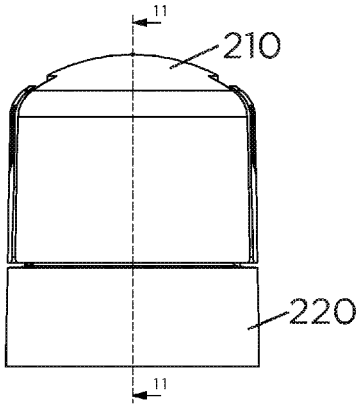
FIG. 10 is a side view of the overcap and collar of the system.
Figure 11:
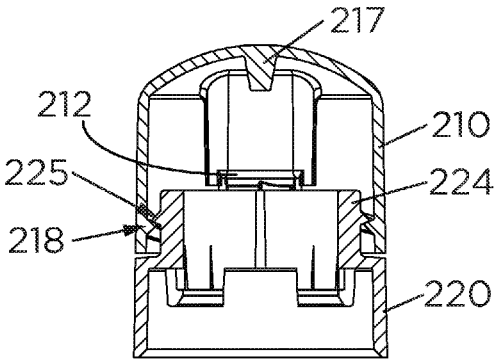
FIG. 11 is a sectional view 11-11 taken from FIG. 10.
Figure 12:
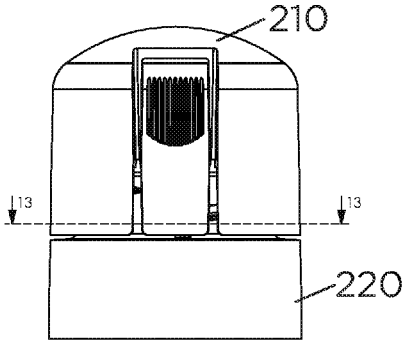
FIG. 12 is a front view of the overcap and collar of the system.
Figure 13:
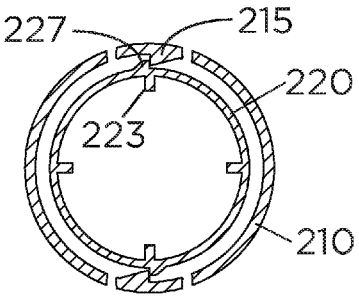
FIG. 13 is a sectional view 13-13 taken from FIG. 12.
Figure 14:
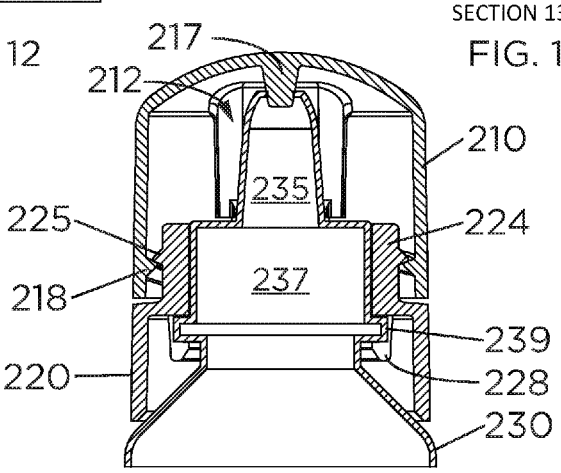
FIG. 14 is a portion of a sectional view of the system taken in the xy-plane.

FIG. 10 is a side view of the overcap and collar of the system, FIG. 11 is a sectional view 11-11 taken from FIG. 10, FIG. 12 is a front view of the overcap and collar of the system, FIG. 13 is a sectional view 13-13 taken from FIG. 12, and FIG. 14 is a portion of a sectional view of the system taken in the xy-plane. Referring to FIG. 14, it is shown how with the overcap 210 placed on collar 220 and locked in place, the partial threads 218 engage the underside of corresponding threads 225 on neck 224 of collar 220. Referring to FIG. 13, it is shown that after the levers 212 have rotated along their corresponding thread 225, the lower vertical members 215 of the levers 212 snap over vertical wall 227, locking the overcap 210 in place.

Operation in general is now described. With overcap 210 in place on the collar 220, actuation of the dispenser tip 235 is locked out. The overcap 210 is retained by the two vertical members 215 at the bottom end of levers 212 that engage with the respective vertical walls 227 on the collar 220 located at the end of corresponding threads 225 on neck 224. When engaging, the overcap 210 is placed on neck 224 and turned in a clockwise motion (approx. ½ turn), the vertical members 215 on the levers 212 engage with the threads 225 causing the bottoms of the levers 212 to deflect outward as the closure is screwed on. Once the vertical members 215 pass the mid plane of the neck 224, the collar threads 225 abruptly end at their vertical wall 227 (extending only below the thread 225) which allows the vertical members 215 on the overcap 210 to snap back to vertical and lock the overcap 210 in place. At this point, each thread 225 is engaged with a corresponding partial thread 218 on the inner surface of overcap 210. The container 230 is sealed by a positive engagement of a pintle 217 located on the overcap 210, sealing against an inner wall of the dispenser tip 235, as shown.

To release the overcap 210, the levers 212 must be pressed simultaneously in an inward motion, causing the vertical members 215 to once again deflect outwards and the overcap 210 can be unscrewed (counter-clockwise), drawn up and off of the dispenser tip 235. With the overcap 210 removed, container 230 is now free to dispense.

Figure 15:
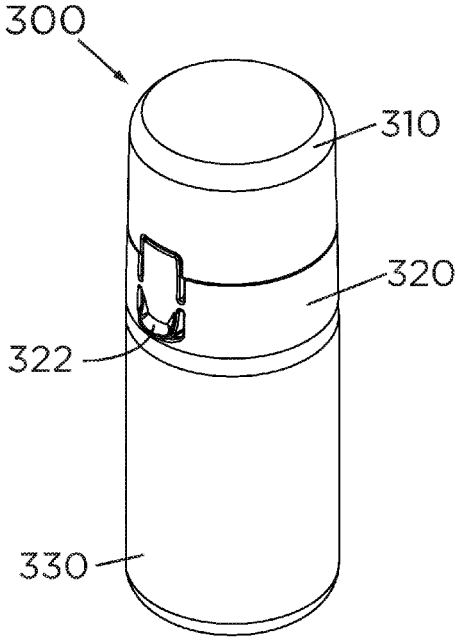
FIG. 15 is a perspective view of a child-resistant closure system for a container according to another example embodiment.
Figure 16:
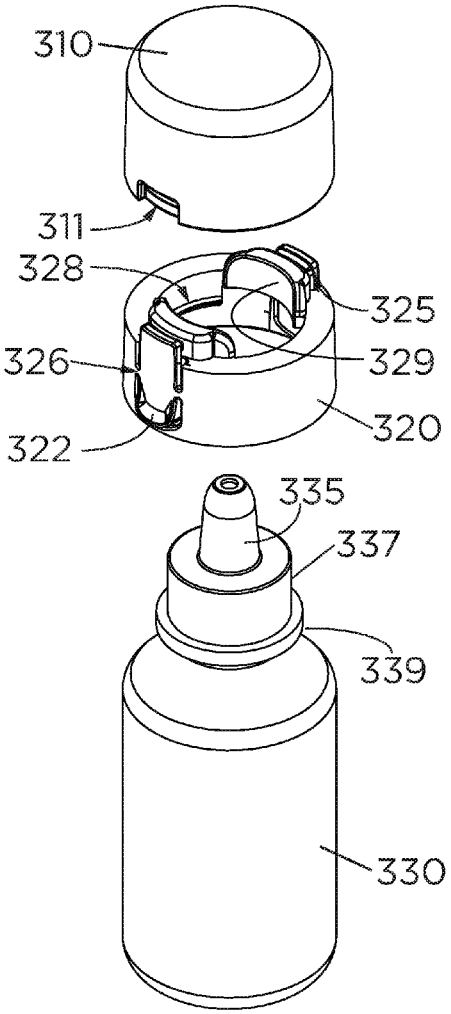
FIG. 16 is an exploded view of the system of FIG. 15.
Figure 17:
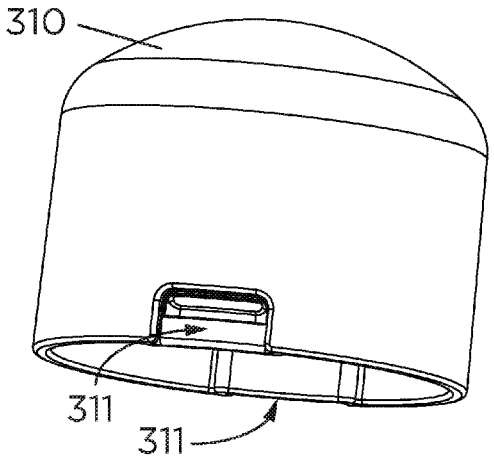
FIG. 17 is a perspective view of the overcap of the system.
Figure 18:
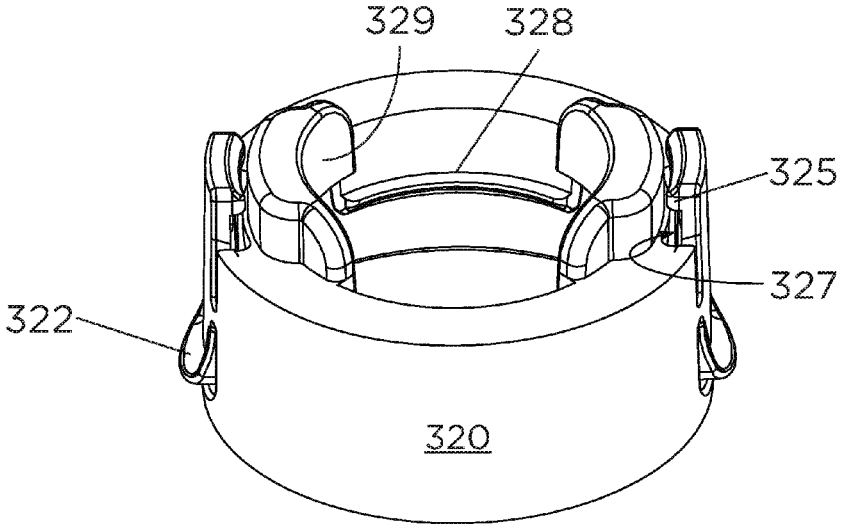
FIG. 18 is a perspective front view of the collar of the system.

FIG. 15 is a perspective view of a child-resistant closure system for a container according to another example embodiment, FIG. 16 is an exploded view of the system of FIG. 15, FIG. 17 is a perspective view of the overcap of the system, and FIG. 18 is a perspective front view of the collar of the system. Referring to FIGS. 15-18, the child-resistant closure (CRC) system 300 includes an overcap 310, a collar 320 and a container 330. Each of the overcap 310, collar 320 and container 330 may be injection molded or extruded or otherwise formed of a suitable plastic material, as is known. The collar 320 includes a pair of levers 322, each 180 degrees from one another on the collar 320. The levers 322 interface in the locking and unlocking of the overcap 310 to/from the collar 320.

The overcap 310 includes a pair of cutouts 311 offset from each other by 180 degrees on a bottom end of the overcap 310. The cutouts 331 engage with tabs 325 that are formed on the back side of levers 322, which grasp the cutouts via cam action of hinges 326 on the levers 322. The collar 320 includes a set of inner ribs 328 formed 180 degrees apart within the collar 320 to form a mechanical bond with the rim 339 of the container 330, and a set of curved forms 329 which contact the bottleneck 337 of container 330. Accordingly, with two sets of mechanical bonds (tabs 325 to cutouts 311 and inner ribs 328 to rim 339), the collar 320 can lockingly engage with both the overcap 310 and container 330, with the overcap 310 and collar 320 contiguously rotatable about the rim 339 and bottleneck 337 of container 330, without being able to be removed.

Figure 20:
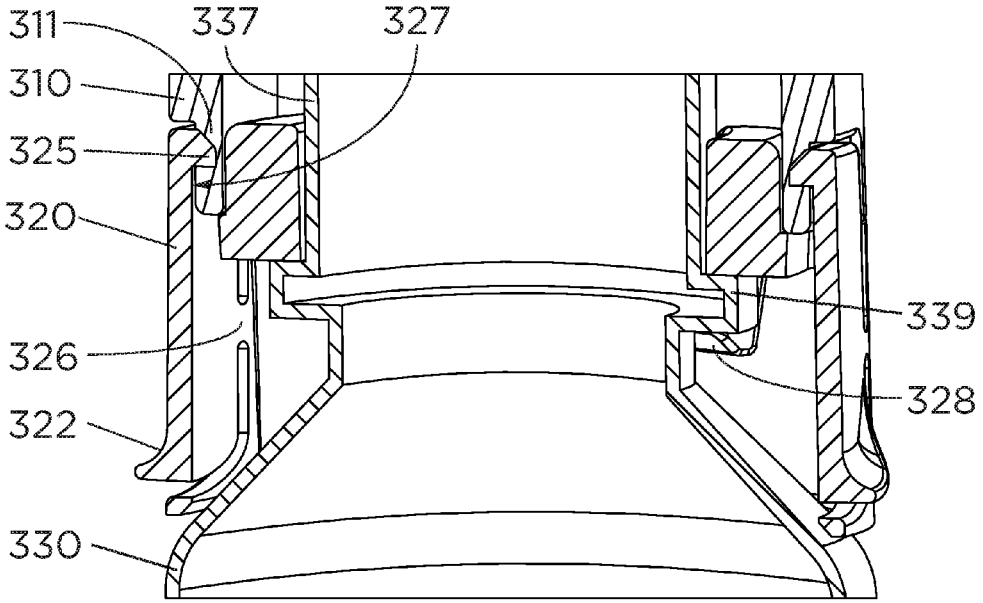
FIG. 20 is a portion of a sectional of a side view of the system taken in an xy-plane.
Figure 19:
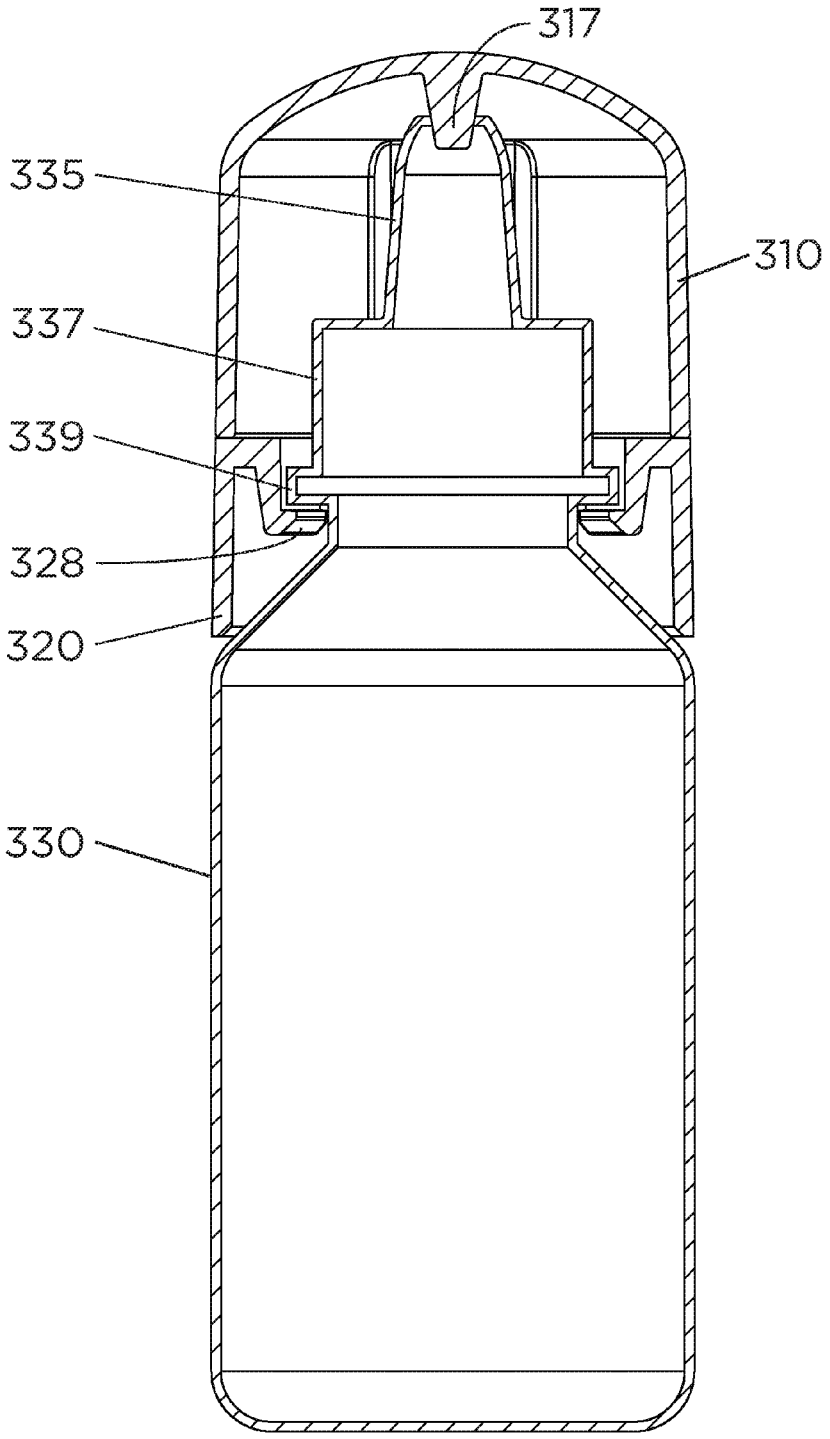
FIG. 19 is a sectional of a front view of the system taken in an xy-plane.

FIG. 19 is a sectional of a front view of the system taken in a xy-plane, and FIG. 20 is a portion of a sectional of a side view of the system taken in a xy-plane. FIG. 19 shows the mechanical bond formed between the inner ribs 328 and the rim 339 of the container in the locked position, and also shows a pintle 317 locking outer container operation of dispenser tip 335 by seating an inner wall of the dispenser tip 335, with overcap 310 in place. FIG. 20 shows the condition with the tabs 325 of the levers 322 engaged in the cutouts 311 in overcap 310 to form a mechanical bond between overcap 310 and collar 320, as well as the secondary mechanical bond between inner ribs 328 and rim 339 of container 330.

In operation, with overcap 310 in place on the collar 320, actuation of the dispenser tip 335 is locked out. Specifically, the overcap 310 is retained by the two tabs 325 on the back side of levers 322 with undercuts 327 that engage with the topside of the cutouts 311 on the overcap 310. When engaging, the tabs 325 will deflect outwards temporarily as the undercuts 327 pass the cutouts 311 on the overcap 310, then the tabs 325 snap back to vertical and engage in the cutouts 311, as shown in FIG. 20. The container 330 is sealed by a positive engagement of the pintle 317 sealing against the inner wall of the dispenser tip 335.

To release the overcap 310, the levers 322 on collar 320 are pressed simultaneously in an inward motion, causing the tabs 325 to once again deflect outwards via hinges 326 and the overcap 310 can be drawn up and off of the dispenser tip 335. With the overcap 310 removed, container 330 is now free to dispense.

Figure 21:
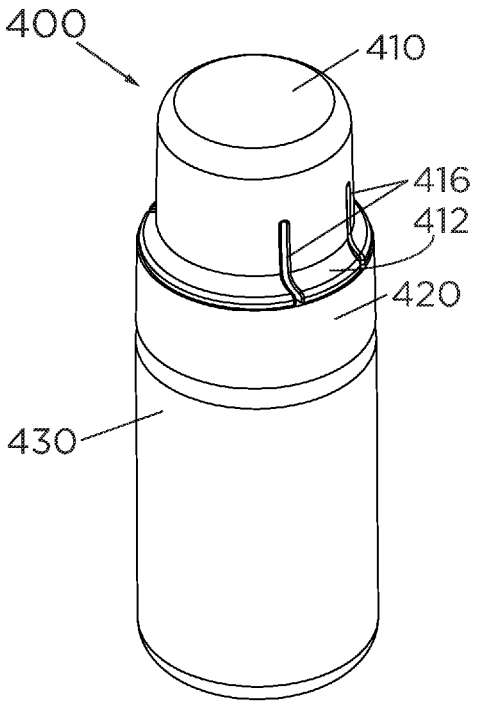
FIG. 21 is a perspective view of a child-resistant closure system for a container according to another example embodiment.
Figure 22:
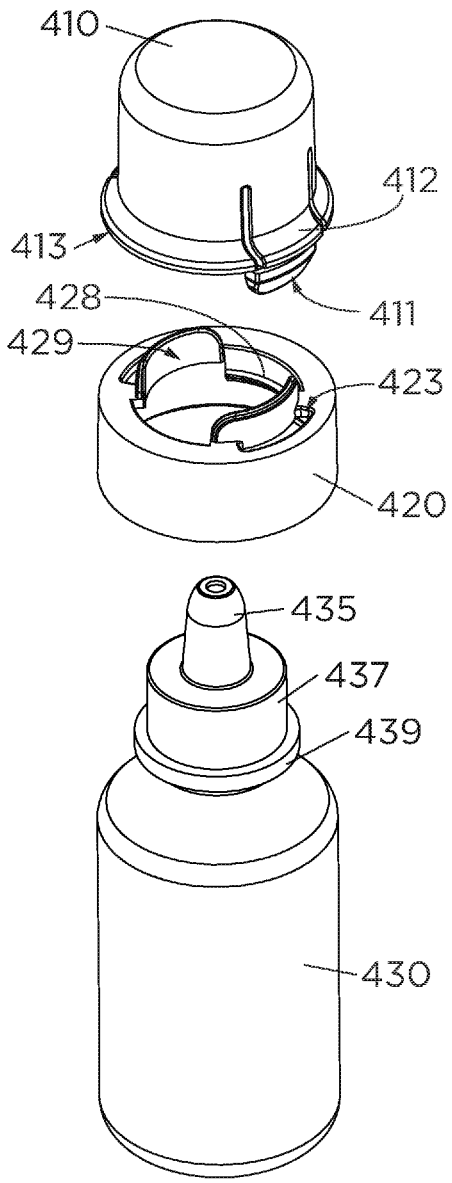
FIG. 22 is an exploded view of the system of FIG. 21.
Figure 23:
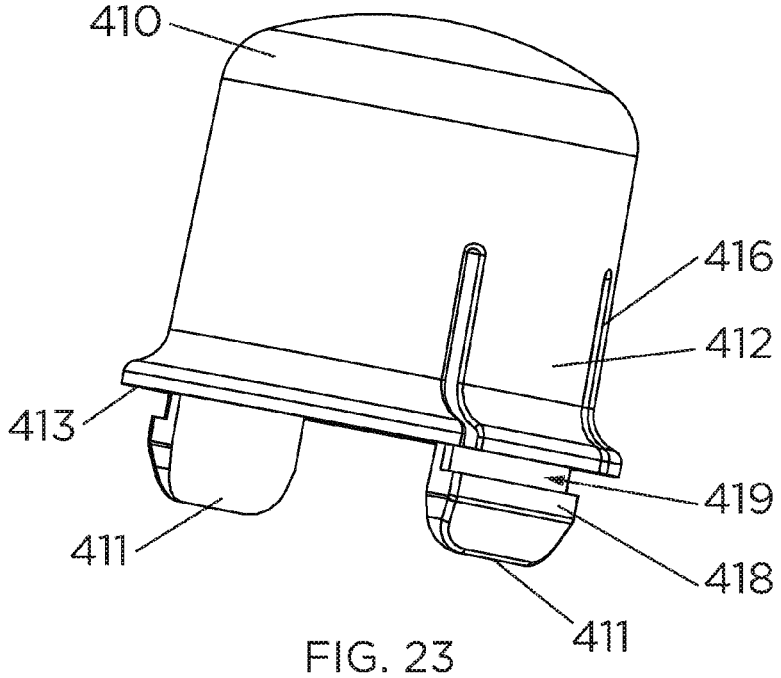
FIG. 23 is a perspective view of the overcap of the system.
Figure 24:
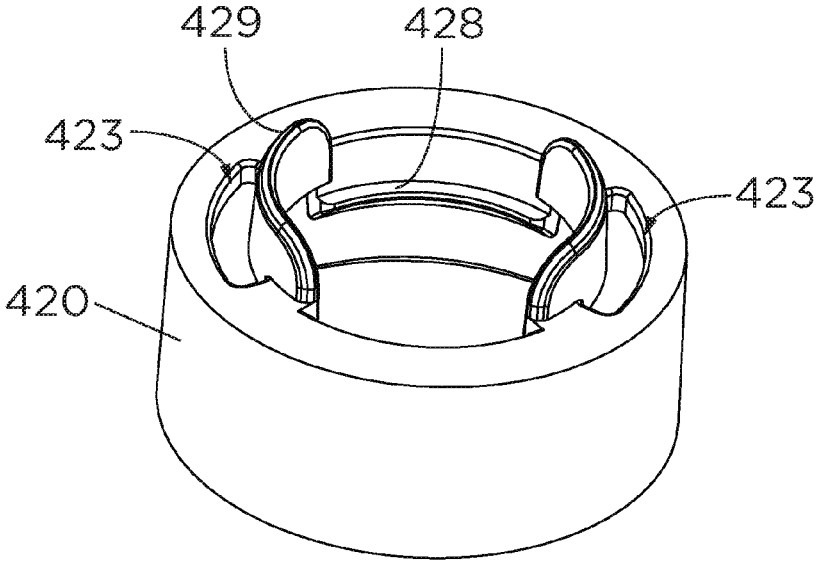
FIG. 24 is a perspective front view of the collar of the system.

FIG. 21 is a perspective view of a child-resistant closure system for a container according to another example embodiment, FIG. 22 is an exploded view of the system of FIG. 21, FIG. 23 is a perspective view of the overcap of the system, and FIG. 24 is a perspective front view of the collar of the system. Referring to FIGS. 21-24, the child-resistant closure (CRC) system 400 includes an overcap 410, a collar 420 and a container 430. Each of the overcap 410, collar 420 and container 430 may be injection molded or extruded or otherwise formed of a suitable plastic material, as is known.

The overcap 410 includes a pair of buttons 412, each 180 degrees from one another on the overcap 410. A pair of slits or reliefs 416 are provided on either side of a button 412 to provide flexibility of movement for the button 412. The buttons 412 interface in the locking and unlocking of the overcap 410 to/from the collar 420 to permit dispenser tip 435 actuation. The overcap includes a pair of legs 411. Each leg 411 is tapered and includes a rib 418 sandwiching an undercut 419 between itself and the rim 413 of overcap 410.

The legs 411 are configured to be seated through cutouts or slots 423 formed in the collar to lockingly engage the overcap 410 to collar 420 via the ribs 418 and undercuts 419. The collar 420 includes a set of inner ribs 428 formed 180 degrees apart within the collar 420 to form a mechanical bond with the rim 439 of the container 430, and a set of curved forms 429 at an upper end of the collar which contact and capture the bottleneck 437 of container 430 above rim 439. Accordingly, with two sets of mechanical bonds (legs 411 to collar 420 via slots 423 and inner ribs 428 to rim 439), the collar 420 can achieve a locked engagement with both the overcap 410 and container 430, with the overcap 410 and collar 420 contiguously rotatable about the rim 439 and bottleneck 437 of container 430, without being able to be removed.

Figure 25:
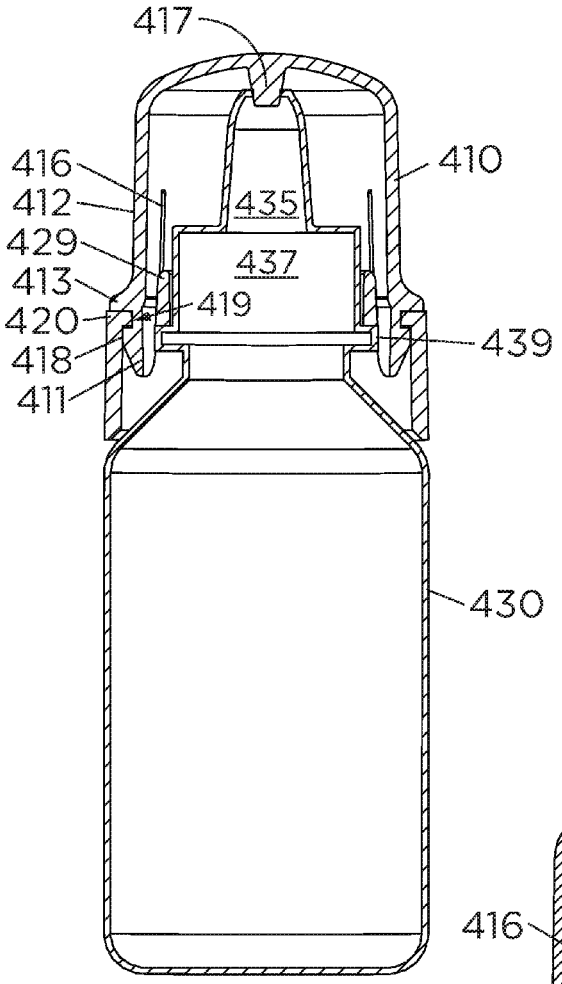
FIG. 25 is a sectional of a front view of the system taken in a xy-plane.
Figure 26:
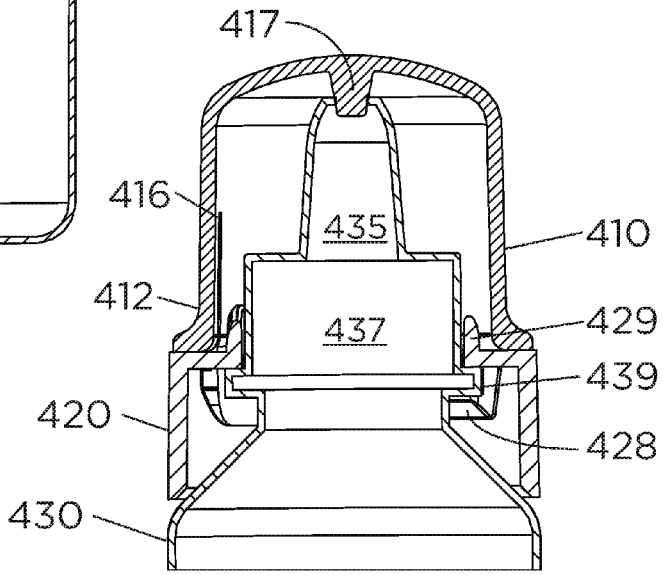
FIG. 26 is a portion of a sectional of a side view of the system taken in a yz-plane.

FIG. 25 is a sectional of a front view of the system taken in a xy-plane, and FIG. 26 is a portion of a sectional of a side view of the system taken in a yz-plane. FIG. 25 shows the locked condition with the legs 411 of overcap 410 engaged in the slots 423 to form a mechanical bond between overcap 410 and collar 420. Specifically, a portion of collar 420 is captured in undercut 419, secured between rib 418 and the rim 413 of overcap 410 at the bottom of button 412. This forms a mechanical bond between the overcap 410 and the collar 420. FIG. 26 shows the mechanical bond formed between the inner ribs 428 and the rim 439 of the container in the locked position, and both FIGS. 25 and 26 show a pintle 417 locking outer container operation of dispenser tip 435 by seating an inner wall of the dispenser tip 435, with overcap 410 in place.

In operation, with overcap 410 in place on the collar 420, actuation of the dispenser tip 435 is locked out. Specifically, the overcap 410 is retained by the two tapered legs 411, with the undercuts 419 that engage with the underside of the slots 423 on the collar 420. When engaging, the legs 411 will deflect inwards until the undercuts 419 pass the slots 423 on the collar, where the legs 411 will snap back to vertical and engage such that a portion of the collar underside slots 423 is captured in the undercuts 419 between ribs 418 and rim 413 on buttons 412. This is shown in FIG. 25.

As for how the lower mechanical bond is formed, the collar 420 is retained to the container 430 by the two inner ribs 428 and the two upper forms 429. The collar 420 is placed over the dispenser tip 435 and pressed onto the bottleneck 437. When applied, the two inner ribs 428 are deflected outward until they pass the rim 439, they then engage below the underside of the rim 439 while the forms 429 capture the bottleneck 437. This engagement is shown in FIG. 26. As shown in FIG. 25, in the locked condition the legs 411 extend to just below the rim 439 of container 430 and allow for the container 430 to be locked out while the overcap 410 is in place. The pintle 417 seats an inner wall of the dispenser tip 435 with overcap 410 in place.

To release the overcap 410, the buttons 412 are pressed simultaneously in an inward motion, causing the legs 411 to once again deflect inward; the overcap 410 then can be drawn up and off of the dispenser tip 435. With the overcap 410 removed, container 430 is now free to dispense.

Figure 27:
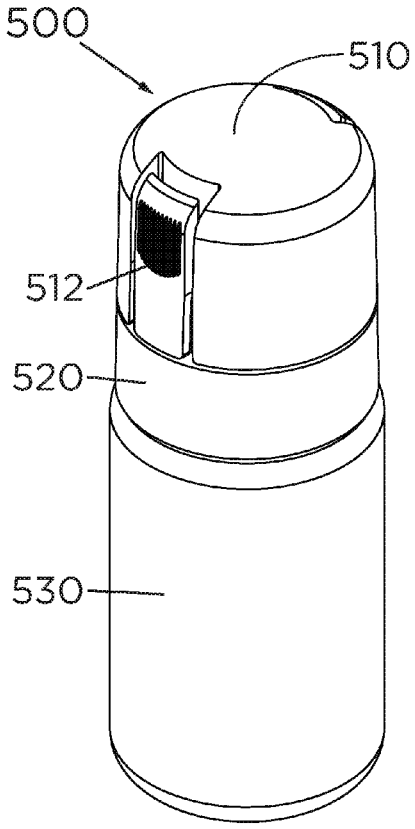
FIG. 27 is a perspective view of a child-resistant closure system for a container according to another example embodiment.
Figure 28:
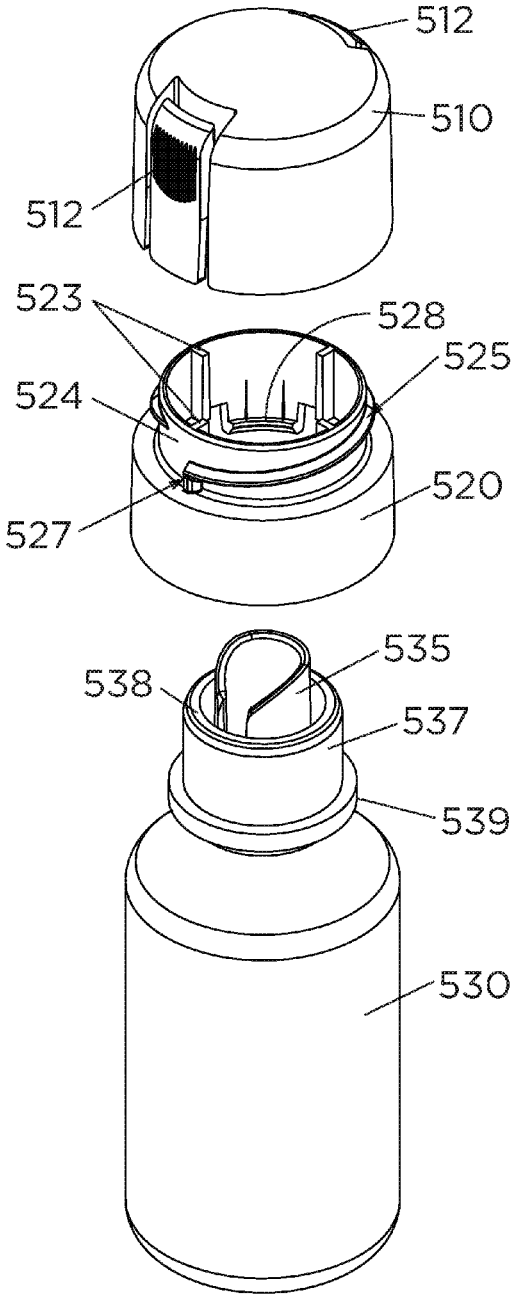
FIG. 28 is an exploded view of the system of FIG. 27.
Figure 29:
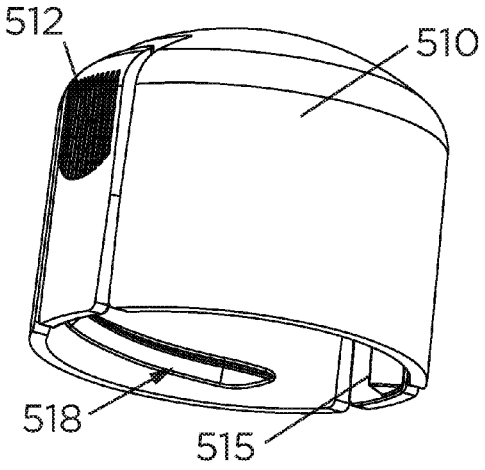
FIG. 29 is a rotated perspective view of the overcap of the system.

FIG. 27 is a perspective view of a child-resistant closure system for a container according to another example embodiment, FIG. 28 is an exploded view of the system of FIG. 27, and FIG. 29 is a rotated perspective view of the overcap of the system. System 500 has the same button 512 and collar 520 configuration as shown in the embodiment described in FIGS. 6-14; accordingly for purposes of brevity only the differences are noted with a refresher on general operation, as the overcap and collar structure are the same. The container 530 employs a pour spout 535 instead of a dispenser tip 235 of system 200; and the overcap employs an interior valve 514 that seals against an interior wall of the pour spout 535 with the overcap 510 in place to lock out dispensing thereof.

Figure 30:
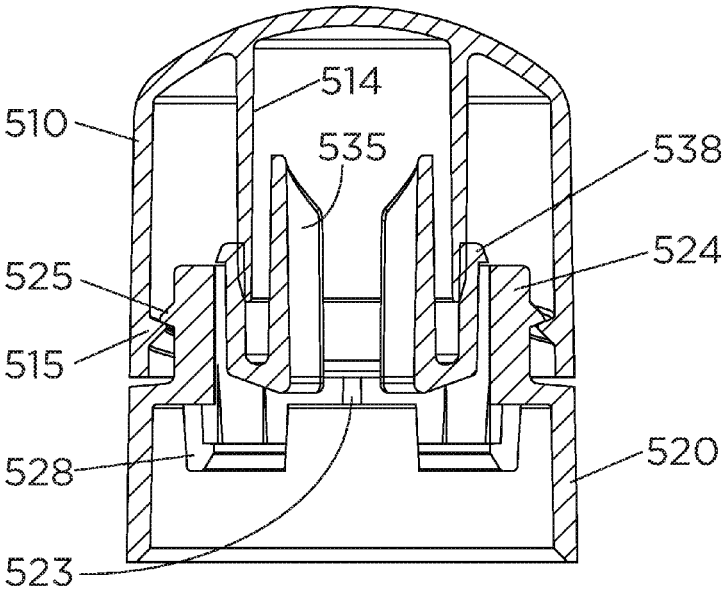
FIG. 30 is a sectional view of the overcap, collar and valve of the container taken in the xy-plane.

FIG. 30 is a sectional view of the overcap, collar and valve of the container taken in the xy-plane. FIG. 30 shows a mechanical bond formed in a locked condition between the vertical members 515 on the button 512 and the pair of threads 525 on the neck 524 of the collar 520. FIG. 30 also shows how the valve 514 acts to seal up against the interior wall of the pour spout 535. Additionally, the vertical ribs 223 spaced around the interior of collar 520 aid in securing the bottleneck 537 and pour spout rim 538, referring to the exploded view of FIG. 28.

In operation, with overcap 210 in place on the collar 520, actuation of the valve 535 is locked out. The overcap 510 is retained by the two vertical members 515 at the bottom end of levers 512 that engage with the respective vertical walls 527 on the collar 520 located at the end of corresponding threads 525 on neck 524. When engaging, the overcap 510 is placed on neck 524 and turned in a clockwise motion (approx. ½ turn), the vertical members 515 on the levers 512 engage with the threads 525 causing the bottoms of the levers 512 to deflect outward as the closure is screwed on. Once the vertical members 515 pass the mid plane of the neck 524, the collar threads 525 abruptly end at their vertical wall 527 (extending only below the thread 525) which allows the vertical members 515 on the overcap 510 to snap back to vertical and lock the overcap 510 in place. At this point, each thread 525 is engaged with a corresponding partial thread 518 on the interior surface of overcap 510. As shown, the overcap 510 is sealed internally by the valve 514 that extends beyond the top sealing surface of the container 530 (below the top of bottleneck 537), tapered with 0.005" interference.

To release the overcap 510, the levers 512 must be pressed simultaneously in an inward motion, causing the vertical members 515 to once again deflect outwards and the overcap 510 can be unscrewed (counter-clockwise), drawn up and off of the collar 520. With the overcap 210 removed, container 530 is now free to dispense.

Figure 31:
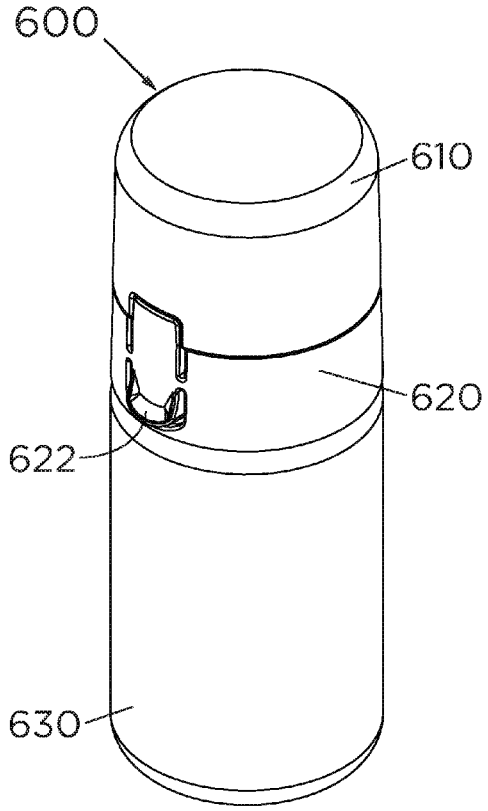
FIG. 31 is a perspective view of a child-resistant closure system for a container according to another example embodiment.
Figure 32:
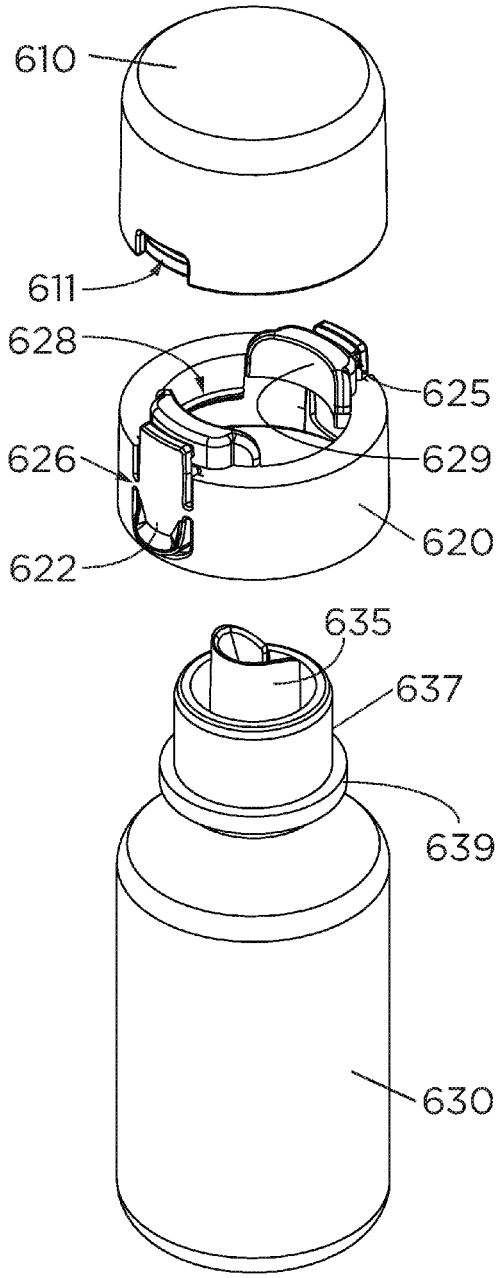
FIG. 32 is an exploded view of the system of FIG. 31.
Figure 33:
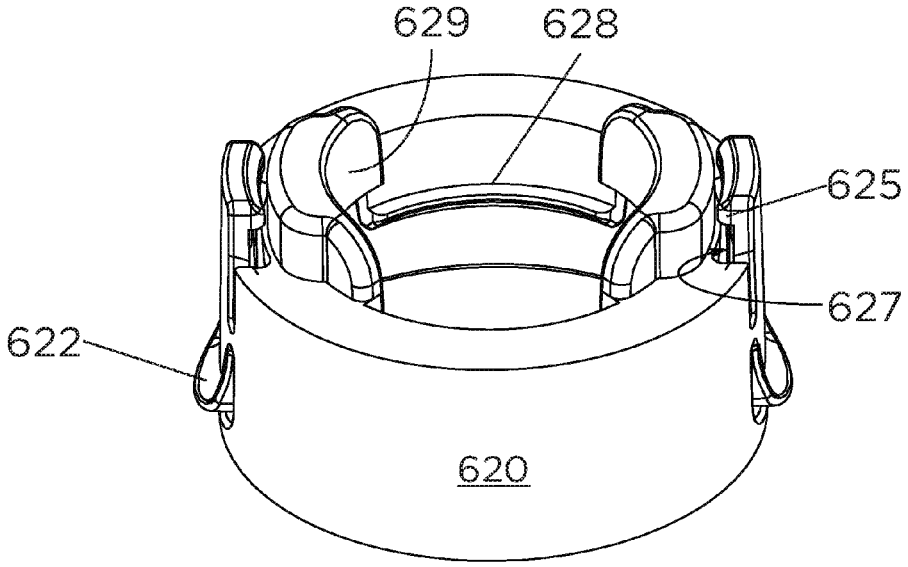
FIG. 33 is a perspective view of the collar of the system.

FIG. 31 is a perspective view of a child-resistant closure system for a container according to another example embodiment, FIG. 32 is an exploded view of the system of FIG. 31, and FIG. 33 is a perspective view of the collar of the system. System 600 has the same overcap 610, lever 622 and collar 620 configuration as shown in the embodiment described in FIGS. 15-20; accordingly for purposes of brevity only the differences are noted with a refresher on general operation, as the overcap and collar structure are the same. The container 630 employs a pour spout 635 instead of the dispenser tip 335 of system 300; and a valve 614 in the interior of overcap 610 is involved with sealing an inner wall of spout 635 to lock out dispensing thereof.

Figure 34:
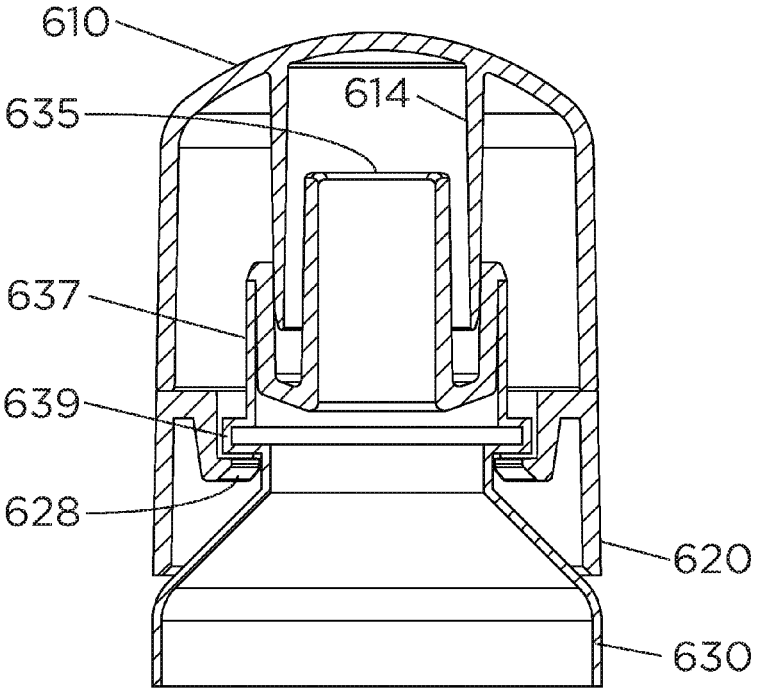
FIG. 34 is a sectional view of the overcap, collar and valve of the container taken in the xy-plane.

FIG. 34 is a sectional view of the overcap, collar and valve of the container taken in the xy-plane. FIG. 34 shows a mechanical bond formed in a locked condition between the inner ribs 628 on the interior of collar 620 and the rim 639 of container 630. FIG. 34 also shows how the valve 614 seals the inner wall of spout 635 with overcap 610 in place.

In operation, with overcap 610 in place on the collar 620, actuation of the spout 635 is locked out. Specifically, the overcap 610 is retained by the two tabs 625 on the back side of levers 622 with undercuts 627 that engage with the topside of the cutouts 611 on the overcap 610. When engaging, the tabs 625 will deflect outwards temporarily as the undercuts 627 pass the cutouts 611 on the overcap 610, then the tabs 625 snap back to vertical and engage in the cutouts 611. The container 630 is sealed by a positive engagement of the valve 614 sealing against the inner wall of the spout 635.

To release the overcap 610, the levers 622 on collar 620 are pressed simultaneously in an inward motion, causing the tabs 625 to once again deflect outwards via hinges 626 and the overcap 610 can be drawn up and off of the collar 620. With the overcap 610 removed, container 630 is now free to dispense.

Figure 35:
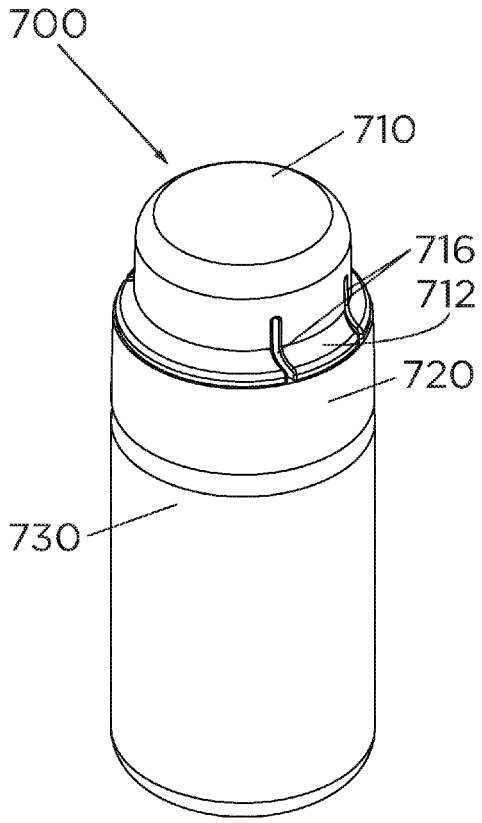
FIG. 35 is a perspective view of a child-resistant closure system for a container according to another example embodiment.
Figure 36:
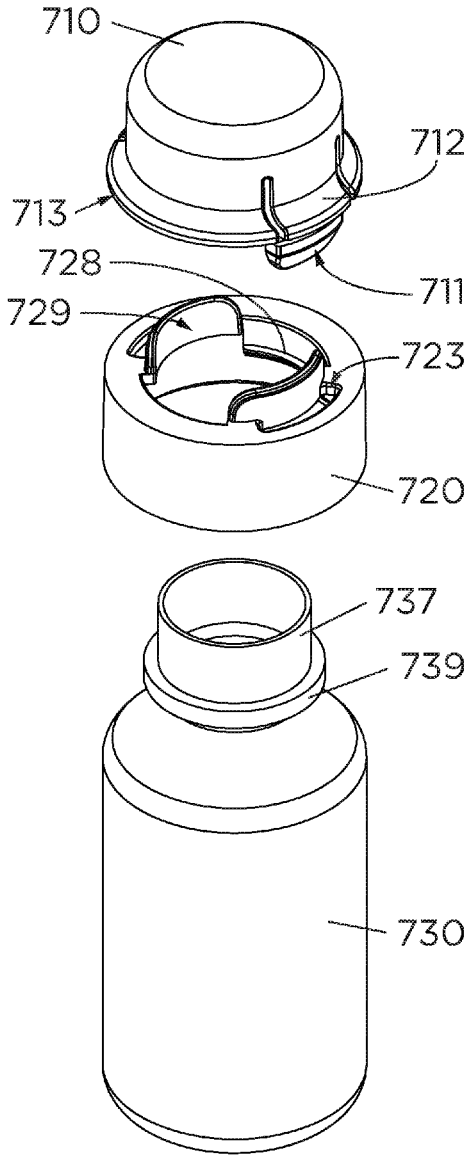
FIG. 36 is an exploded view of the system of FIG. 35.
Figure 37:
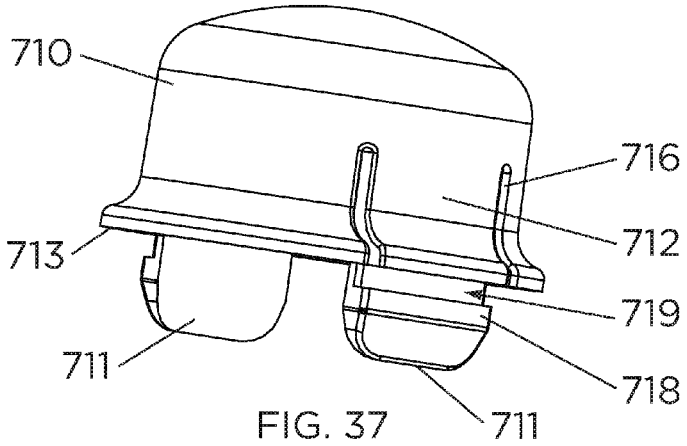
FIG. 37 is a perspective view of the overcap of the system.

FIG. 35 is a perspective view of a child-resistant closure system for a container according to another example embodiment, FIG. 36 is an exploded view of the system of FIG. 35, and FIG. 37 is a perspective view of the overcap of the system. System 700 has similar overcap 710 with associated button 712 and leg 711 structure, and collar 620 configuration as shown in the embodiment described in FIGS. 21-26; accordingly for purposes of brevity only the differences are noted with a refresher on general operation, as the overcap and collar structure are essentially the same. The container 630 employs now dispenser tip nor pour spout but merely an open bottleneck 737 of container 730. Also, the overcap 710 is provided with an interior valve 714 that seals the opening in the bottleneck 737 to lock out dispensing thereof.

Figure 38:
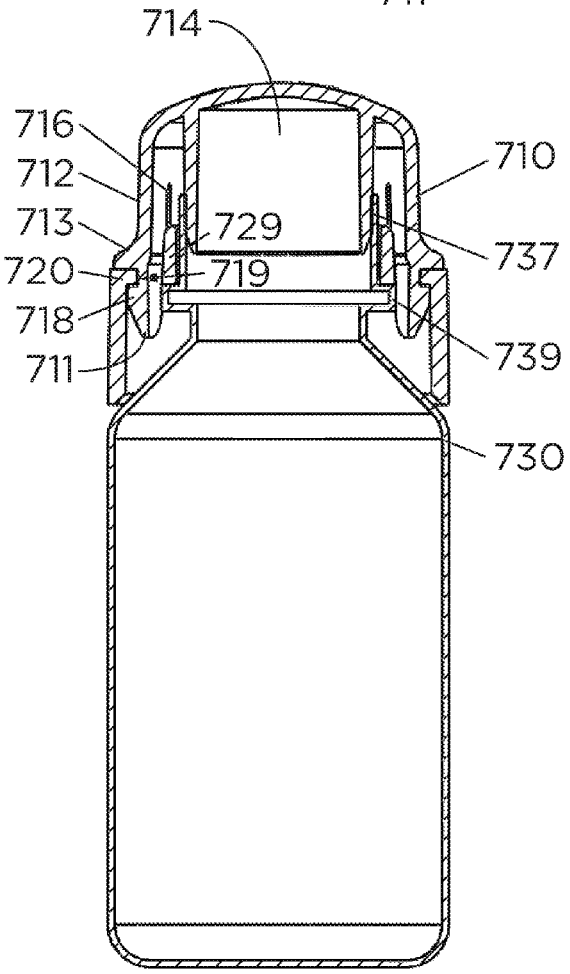
FIG. 38 is a sectional view of the overcap, collar and valve of the container taken in the xy-plane.

FIG. 38 is a sectional view of the overcap, collar and valve of the container taken in the xy-plane. FIG. 38 shows the locked condition with the legs 711 of overcap 710 engaged in the slots 723 to form a mechanical bond between overcap 710 and collar 720. Specifically, a portion of collar 720 is captured in undercut 719, secured between rib 718 and the rim 713 of overcap 770 at the bottom of button 712 (both sides). This forms a mechanical bond between the overcap 710 and the collar 720. Although not shown in this view, there is a second mechanical bond formed between the inner ribs 728 of collar 720 and the rim 739 of the container 730 in the locked position. Further, valve 714 is shown sealing the inner walls of the bottleneck 737 to lock out dispensing and thus seal the overcap 710.

In operation, with overcap 710 in place on the collar 720, actuation of the container 730 is locked out. Specifically, the overcap 710 is retained by the two tapered legs 711, with the undercuts 719 that engage with the underside of the slots 723 on the collar 720. When engaging, the legs 711 will deflect inwards until the undercuts 719 pass the slots 723 on the collar, where the legs 711 will snap back to vertical and engage such that a portion of the collar underside of the slots 723 is captured in the undercuts 719 between ribs 718 and rim 713 on buttons 712. This is shown in FIG. 38.

As for how the lower mechanical bond is formed, the collar 720 is retained to the container 730 by the two inner ribs 728 and the two upper forms 729. The collar 720 is pressed onto the bottleneck 737. When applied, the two inner ribs 728 are deflected outward until they pass the rim 739, they then engage below the underside of the rim 739 while the forms 729 capture the bottleneck 737. As shown in FIG. 38, in the locked condition the legs 711 extend to just below the rim 739 of container 730 and allow for the container 730 to be locked out while the overcap 710 is in place. The overcap 710 is sealed by the valve 714 that extends beyond the top sealing surface of the container 730 (below the upper end of bottleneck 737), tapered with 0.005" interference.

To release the overcap 710, the buttons 712 are pressed simultaneously in an inward motion, causing the legs 711 to once again deflect inward; the overcap 710 then can be drawn up and off of the dispenser tip 735. With the overcap 710 removed, container 730 is now free to dispense.

The example embodiments being thus described, it will be obvious that the same may be varied in many ways. Such variations are not to be regarded as departure from the example embodiments, and all such modifications as would be obvious to one skilled in the art are intended to be included herein.

We claim:

1. A child-resistant closure system for a container, comprising:

an overcap, the overcap including a pair of levers, each lever 180 degrees apart from the other and formed into a side facing of the overcap, each lever including a lower vertical member provided on an interior side thereof which protrudes into an interior space of the overcap, the overcap including a pair of partial threads extending along an inner surface at the bottom of the overcap, each partial thread 180 degrees apart from the other; and a cylindrical collar configured to receive the overcap thereon, the collar having an opening configured to receive a dispenser tip and bottleneck of the container therethrough, the collar forming a mechanical bond with the bottleneck, the collar including a neck having a smaller diameter than that of the collar, the neck having a pair of neck threads formed around an external surface thereof, each neck thread 180 degrees apart from the other on the neck, each neck thread terminating at a truncated vertical wall formed on the neck external surface;

wherein the overcap is locked to the collar to prevent actuation of the dispenser tip of the container by rotating the overcap onto the neck in a clockwise direction, so that the lower vertical member of each of the levers is deflected outward by a respective one of the neck threads and rides along a respective one of the neck threads during rotation until the lower vertical member of each of the levers comes into engagement with a respective one of the vertical walls on the neck, and so that each partial thread on the inner surface of the overcap engages the underside of a corresponding neck thread; and wherein the overcap is unlocked by simultaneously pressing both levers inward, which causes the lower vertical members of the levers to deflect outward and away from the vertical walls of the neck, and then rotating the overcap in a counter-clockwise direction to remove the overcap from the collar and expose the dispenser tip of the container.

2. The child-resistant closure system of claim 1, wherein the lower vertical member of each of the levers comprises a surface that is at an acute angle relative to the interior side of the corresponding lever and a surface that is perpendicular to the interior side of the corresponding lever.

3. The child-resistant closure system of claim 2, wherein the acute angled surface of each lower vertical member of the levers rides along the corresponding neck thread during rotation and the perpendicular surface of each lower vertical member of the levers engages the corresponding vertical wall on the neck.

4. The child-resistant closure system of claim 2, wherein the perpendicular surface of each lower vertical member of the levers engages the corresponding vertical wall on the neck when the overcap has rotated in the clockwise direction to a point at which the perpendicular surface of each lower vertical member of the levers has rotated past the corresponding vertical wall on the neck and the lower vertical members of the levers return to their undeflected positions.

5. The child-resistant closure system of claim 1, wherein each lever comprises an upper portion, a lower portion, and a pivot point therebetween, each lever being affixed to the overcap via its respective pivot point.

6. The child-resistant closure system of claim 1, wherein the collar comprises opposing horizontal ribs formed on an interior wall of the collar;

wherein the mechanical bond between the collar and the bottleneck is formed by the ribs engaging with a horizontal rim on the bottleneck.

* * * * *